US008344951B2

(12) United States Patent
Kang

(10) Patent No.: US 8,344,951 B2
(45) Date of Patent: Jan. 1, 2013

(54) ANTENNA FOR USE IN RADIO FREQUENCY IDENTIFICATION (RFID) DEVICE

(75) Inventor: Hee Bok Kang, Cheongju (KR)

(73) Assignee: Hynix Semiconductor Inc., Icheon-Si (KR)

( * ) Notice: Subject to any disclaimer, the term of this patent is extended or adjusted under 35 U.S.C. 154(b) by 415 days.

(21) Appl. No.: 12/755,306

(22) Filed: Apr. 6, 2010

(65) Prior Publication Data

US 2011/0148737 A1 Jun. 23, 2011

(30) Foreign Application Priority Data

Dec. 23, 2009 (KR) ..... 10-2009-0129393

(51) Int. Cl.
*H01Q 1/12* (2006.01)

(52) U.S. Cl. ..... 343/700 MS; 343/795; 340/572.7; 340/572.8

(58) Field of Classification Search ..... 343/700 MS, 343/793, 795; 340/572.7, 572.8
See application file for complete search history.

(56) References Cited

U.S. PATENT DOCUMENTS

| | | | | |
|---|---|---|---|---|
| 6,100,804 | A * | 8/2000 | Brady et al. | 340/572.7 |
| 2005/0223286 | A1 * | 10/2005 | Forster | 714/25 |
| 2007/0095922 | A1 * | 5/2007 | Kawai | 235/492 |
| 2008/0204244 | A1 * | 8/2008 | Carrender et al. | 340/572.1 |
| 2008/0252425 | A1 * | 10/2008 | Okegawa et al. | 340/10.1 |

FOREIGN PATENT DOCUMENTS

KR 10-2007-0104295 A 10/2007

* cited by examiner

*Primary Examiner* — Tho G Phan

(57) ABSTRACT

An antenna for use in an RFID device is disclosed. The antenna of the RFID device includes an antenna substrate including a cavity in which an RFID chip is inserted, and also includes a first antenna electrode and a second antenna electrode. The first and second antenna electrodes are formed on the antenna substrate so as to connect to the RFID chip, and are tilted at specific slopes while interposing the cavity therebetween. The antenna is connected to the RFID chip using a simple insertion method, so that connection speed is increased.

17 Claims, 7 Drawing Sheets

(a)CHIP-ANTENNA CONNECTION STRUCTURE METHOD (b)ACTUAL ANTENNA STRUCTURE

ANTENNA FOR USE IN RADIO FREQUENCY IDENTIFICATION (RFID) DEVICE

CROSS-REFERENCE TO RELATED APPLICATION

The priority of Korean patent application No. 10-2009-0129393 filed on Dec. 23, 2009, the disclosure of which is hereby incorporated in its entirety by reference, is claimed.

BACKGROUND OF THE INVENTION

Embodiments of the present invention relate to a radio frequency identification (RFID) device, and more specifically, to a manufacturing method to reduce the footprint of a RFID tag chip and antenna assembly.

A radio frequency identification (RFID) tag chip has been widely used to automatically identify objects using a radio frequency (RF) signal. In order to automatically identify an object using the RFID tag chip, an RFID tag is first attached to the object to be identified, and an RFID reader wirelessly communicates with the RFID tag of the object in such a manner that a non-contact automatic identification scheme can be implemented. With the widespread use of such RFID technologies, the shortcomings of related automatic identification technologies, such as barcode and optical character recognition technologies, can be greatly reduced.

In recent times, the RFID tag has been widely used in physical distribution management systems, user authentication systems, electronic money (e-money), transportation systems, and the like.

For example, the physical distribution management system generally performs a classification of goods or management of goods in stock using an Integrated Circuit (IC) recording data therein, instead of using a delivery note or tag. In addition, the user authentication system generally performs an Entrance and Exit Management function using an IC card including personal information or the like.

In the meantime, a non-volatile ferroelectric memory may be used as a memory in an RFID tag.

Generally, a non-volatile ferroelectric memory, e.g., a ferroelectric Random Access Memory (FeRAM), has a data processing speed similar to that of a Dynamic Random Access Memory (DRAM). The non-volatile ferroelectric memory also preserves data even when power is turned off. Because of these properties many developers are conducting intensive research into FeRAM as a next generation memory device.

The above-mentioned FeRAM has a very similar structure to that of DRAM, and uses a ferroelectric capacitor as a memory device. The ferroelectric substance has high residual polarization characteristics, such that data is not deleted although an electric field is removed.

FIG. 1 is a block diagram illustrating a general RFID device. The RFID device according to the related art generally includes an antenna unit 1, an analog unit 10, a digital unit 20, and a memory unit 30.

In this case, the antenna unit 1 receives a radio frequency (RF) signal from an external RFID reader. The RF signal from the antenna unit 1 is input to the analog unit 10 via antenna pads 11 and 12.

The analog unit 10 amplifies the input RF signal, such that it generates a power-supply voltage VDD indicating a driving voltage of an RFID tag. The analog unit 10 detects an operation command signal from the input RF signal, and outputs a command signal CMD to the digital unit 20. In addition, the analog unit 10 detects the output voltage VDD, such that it outputs not only a power-on reset signal POR controlling a reset operation but also a clock CLK to the digital unit 20.

The digital unit 20 receives the power-supply voltage VDD, the power-on reset signal POR, the clock CLK, and the command signal CMD from the analog unit 10, and outputs a response signal RP in response to the received signals to the analog unit 10. The digital unit 20 outputs an address ADD, Input/Output data (I/O), a control signal CTR, and a clock CLK to the memory unit 30.

The memory unit 30 reads and writes data using a memory device, and stores data therein.

In this case, the RFID device uses frequencies of various bands. In general, as the value of a frequency band is lowered, the RFID device has a slower recognition speed, has a shorter operating distance, and is less affected by environments (e.g., disruption from WiFi, cellphones, etc.) In contrast, as the value of a frequency band is increased, the RFID device has a faster recognition speed, has a greater operating distance, and is considerably affected by peripheral environments.

In the meantime, an improved technology has lately attracted considerable attention where a through-hole electrode is formed so that a transmission path from an upper part to a lower part of a chip is made (i.e., the top and bottom surface of the chip can become the contact terminals of the chip). A conventional connection scheme, such as a wire bonding or a flip chip, has difficulty in reducing the size of a corresponding connection area within an RFID tag chip. That is, an additional layout space for forming a plurality of pads on a front side of a wafer is needed.

BRIEF SUMMARY OF THE INVENTION

Various embodiments of the present invention are directed to providing an antenna for use in an RFID device that substantially obviates one or more problems due to limitations and disadvantages of the related art.

First, an embodiment of the present invention relates to an antenna for use in an RFID device. Herein, an antenna substrate is formed at a lower part of the antenna so that the antenna is easily connected to an external driving device.

Second, an embodiment of the present invention relates to an antenna for use in an RFID device. Herein, a cavity is formed at an antenna substrate, and an antenna electrode is configured in the form of a sloped structure, so that an RFID chip is easily inserted into the cavity of the antenna substrate through a compression tension.

In accordance with an embodiment of the present invention, an antenna for use in a radio frequency identification (RFID) device includes an antenna substrate including a cavity in which an RFID chip is inserted, and a first antenna electrode and a second antenna electrode which are formed on the antenna substrate so as to connect to the RFID chip, and are tilted at specific slopes while interposing the cavity therebetween.

As described above, the embodiment of the present invention has the following effects.

First, an antenna substrate is formed at a lower part of the antenna, so that it is easily connected to an external driver.

Second, the RFID chip is easily inserted into the antenna substrate through compression tension, so that a connection speed between the antenna and the RFID chip is increased.

Third, the antenna is connected to the RFID chip at high speed according to a simple insertion method, so that a relatively expensive bump process is omitted, resulting in reduction of production costs.

It is to be understood that both the foregoing general description and the following detailed description of the present invention are exemplary and explanatory and are intended to provide further explanation of the invention as claimed.

It will be appreciated by persons skilled in the art that that the effects that can be achieved with the present invention are not limited to what has been particularly described hereinabove and other advantages of the present invention will be more clearly understood from the following detailed description taken in conjunction with the accompanying drawings.

DESCRIPTION OF EMBODIMENTS

Reference will now be made in detail to the embodiments of the present invention, examples of which are illustrated in the accompanying drawings. Wherever possible, the same reference numbers will be used throughout the drawings to refer to the same or like parts.

Figure 1:
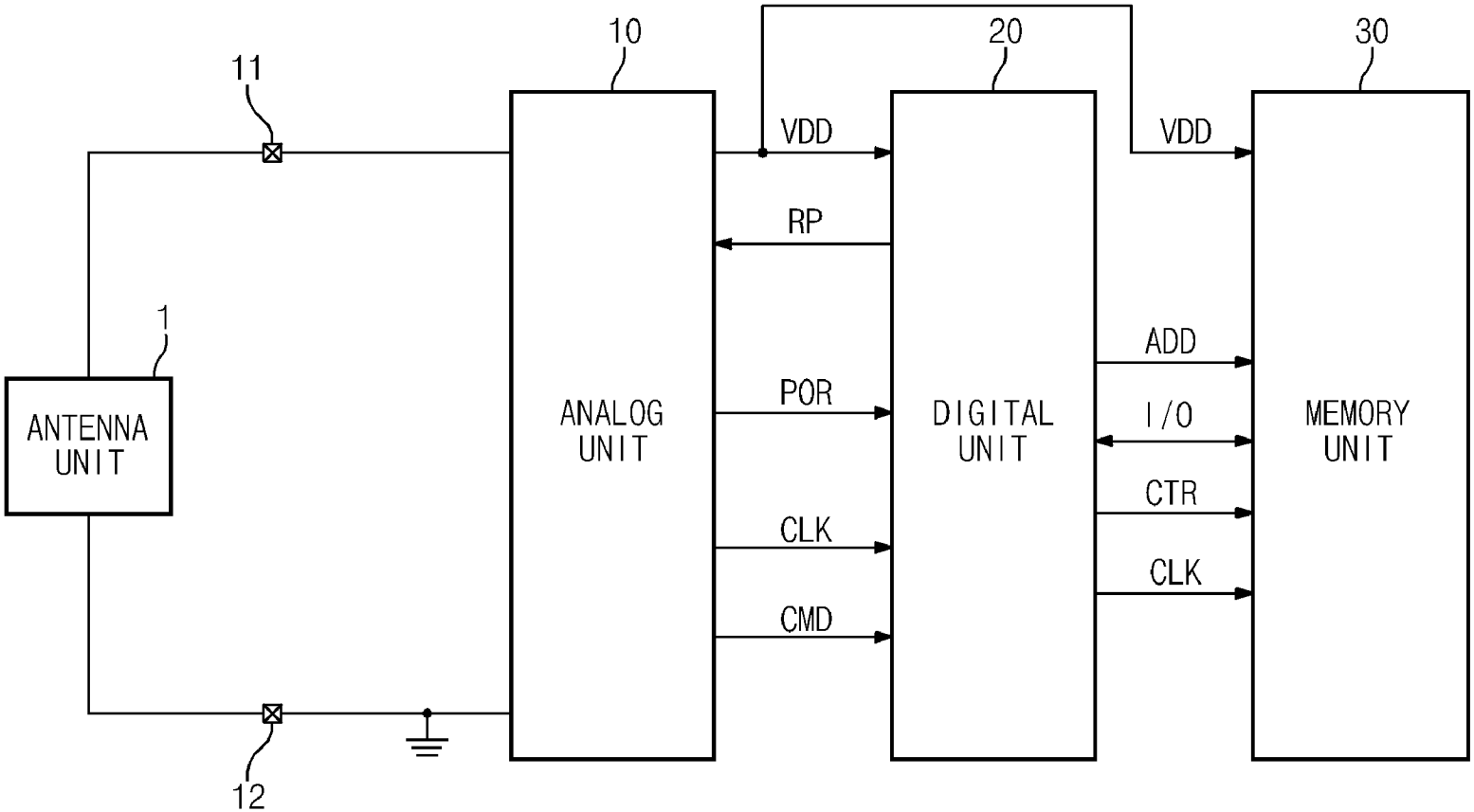
Fig.1 (Prior art)
FIG. 1 is a block diagram illustrating a conventional RFID device according to a related art.
Figure 2:
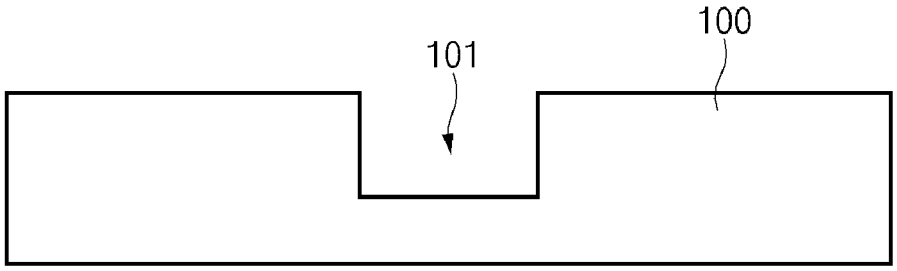
FIGS. 2 to 5 are cross-sectional views illustrating an antenna structure for use in an RFID device according to embodiments of the present invention.

FIG. 2 is a structural view illustrating an antenna substrate 100 for use in a radio frequency identification (RFID) device. Referring to FIG. 2, a cavity 101 is formed in a certain area of the antenna substrate 100 so that an RFID chip can be inserted into the cavity 101. In more detail, FIG. 2 is a structural view illustrating the antenna substrate 100 for forming an antenna pattern. In this case, in order to provide a space wherein the RFID chip is inserted, the cavity 101 is formed in the antenna substrate 100.

Figure 3:
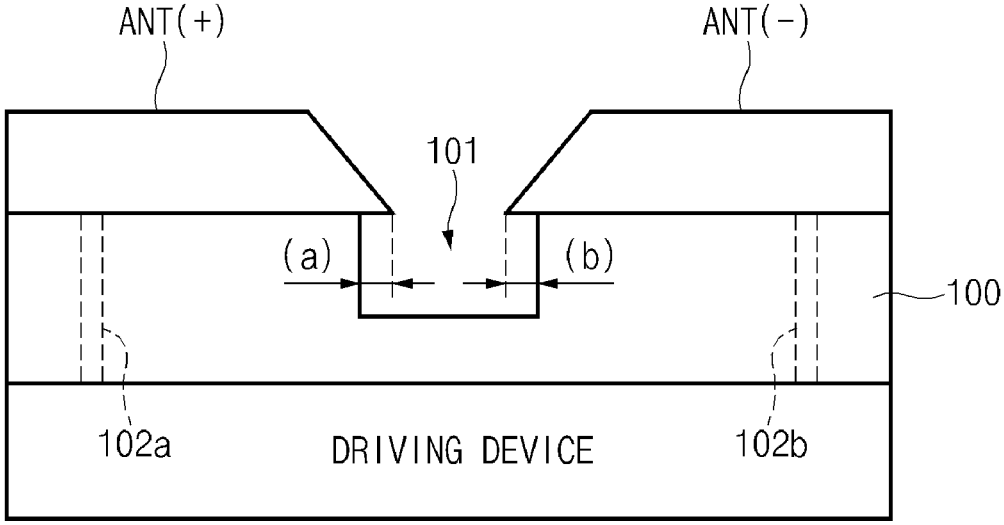

FIG. 3 is a structural view illustrating a connection structure between the antenna substrate 100 and the antenna electrode ANT(+) or ANT(−).

In this case, the cavity 101 of the antenna substrate 100 is arranged to face two antenna electrodes ANT(+) and ANT(−). The antenna substrates ANT(+) and ANT(−) are formed on the antenna substrate 100, and may be tilted at specific slopes while interposing the cavity 101 therebetween. In one embodiment, a lower portion of each antenna electrodes ANT (+) and ANT (−) extends further toward the cavity 101 than an upper portion thereof.

In the present embodiment, the antenna electrodes ANT(+) and ANT(−) are configured to protrude by a predetermined length as shown in reference symbols (a) and (b) at an upper part of the cavity 101, and are brought into contact with the RFID chip. Therefore, the RFID chip can be easily inserted into the cavity 101 in a subsequent step.

A driving device (e.g., LED, speaker, etc.) may be connected to a lower area of the antenna substrate 100. In this case, through-via parts 102*a* and 102*b* formed on the antenna substrate 100 so that they pass through the antenna substrate 100. Therefore, the antenna electrodes ANT(+) and ANT(−) communicate with an external driving device via through-via parts 102*a* and 102*b* provided in the antenna substrate 100, respectively. In this case, the driving device may include a light emitting diode (LED), a motor, a speaker, or the like.

Figure 4:
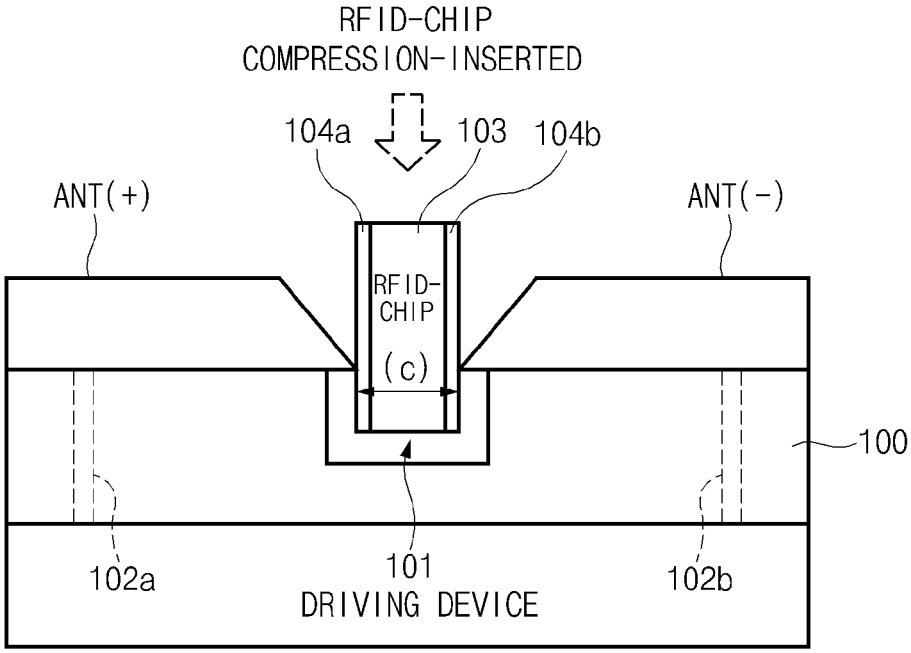

FIG. 4 is a structural view illustrating a structure for inserting an RFID chip 103 between the antenna electrodes ANT(+) and ANT(−) according to an embodiment of the present invention.

Referring to FIG. 4, the RFID chip 103 is interposed between two antenna electrodes ANT(+) and ANT(−), and the top part of the RFID chip 103 is pressed so that the RFID chip 103 is compression-inserted into the cavity 101 of the antenna substrate 100. In this case, pad electrodes 104*a* and 104*b* are formed to connect to the antenna electrodes ANT(+) and ANT(−) at both sides of the RFID chip 103.

In this case, the interval between the two antenna electrodes ANT(+) and ANT(−) is less than a width of the RFID chip 103 by a predetermined distance. Accordingly, when the RFID chip 103 is inserted between the antenna electrodes ANT(+) and ANT(−), the RFID chip 103 and each antenna electrode ANT(+) or ANT(−) provide enough friction force so that the RFID chip 103 does not come off from each antenna electrode ANT(+) or ANT(−) (i.e., maintains electrical connection).

In this case, the width of the RFID chip 103 includes both widths of the two pad electrodes 104*a* and 104*b* connected to both ends of the RFID chip 103.

In this case, a specific part where two antenna electrodes ANT(+) and ANT(−) face each other (i.e., the top corner of the electrodes above the cavity 101) is beveled with a specific angle. In one embodiment, a lower portion extends further toward the cavity 101 than the upper portion thereof. In another embodiment, the electrodes have an oval shape so that a middle portion extends further toward the cavity 101 than the upper portion or the lower portion. The shape of the electrodes are configured to enable the RFID chip 103 to be more easily inserted into the cavity 101.

In this case, the antenna electrodes ANT(+) and ANT(−) including the RFID chip 103 interposed therebetween become bent and/or compressed by a spring action. The antenna electrodes ANT(+) and ANT(−) have slight elastic characteristics, so that they are not broken or scratched although the RFID chip 103 is physically inserted between the antenna electrodes ANT(+) and ANT(−). The RFID chip 103 is inserted to a specific depth so that the RFID chip 103 does not become separated from the cavity. However the RFID chip 103 may be inserted to the bottom of the cavity 101 without any problems.

In this case, the RFID chip is inserted into the cavity 101 by an external force, so that the RFID chip 103 can be easily connected to the antenna electrodes ANT(+) and ANT(−). Therefore, it is not necessary to use a relatively expensive bump layer required for inserting the RFID chip 103 between the antenna electrodes ANT(+) and ANT(−).

Figure 5:
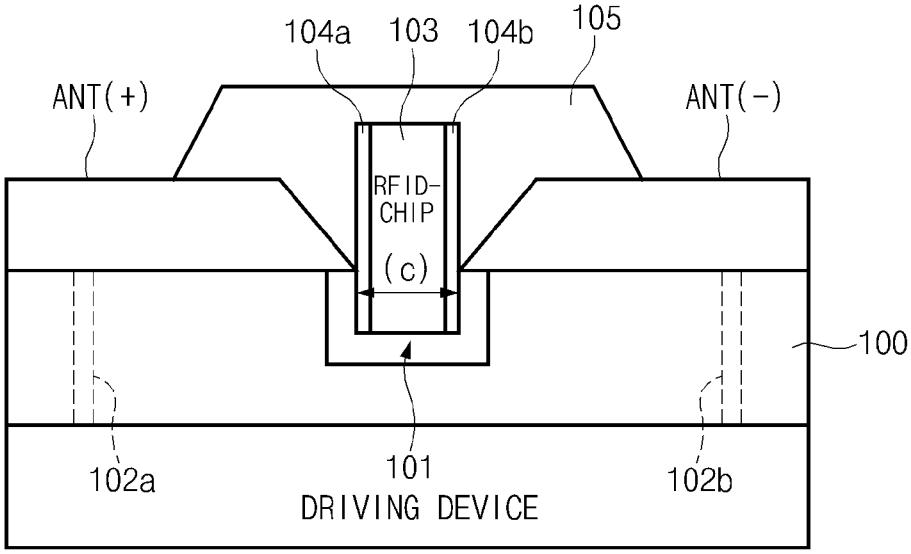

FIG. 5 illustrates a molding layer structure of an antenna according to an embodiment of the present invention.

Referring to FIG. 5, the RFID chip 103 is inserted between the antenna electrodes ANT(+) and ANT(−), and the antenna electrodes ANT(+) and ANT(−) and the RFID chip 103 are covered with the molding layer 105. In this case, the molding layer 105 may be formed of a molding material such as a polymer, a resin, or a plastic material. The molding layer 105 is deposited on the antenna electrodes ANT(+) and ANT(−) and the RFID chip 103. If the molding layer 105 is heated, the molding structure for covering the RFID chip 103 is formed.

Figure 6:
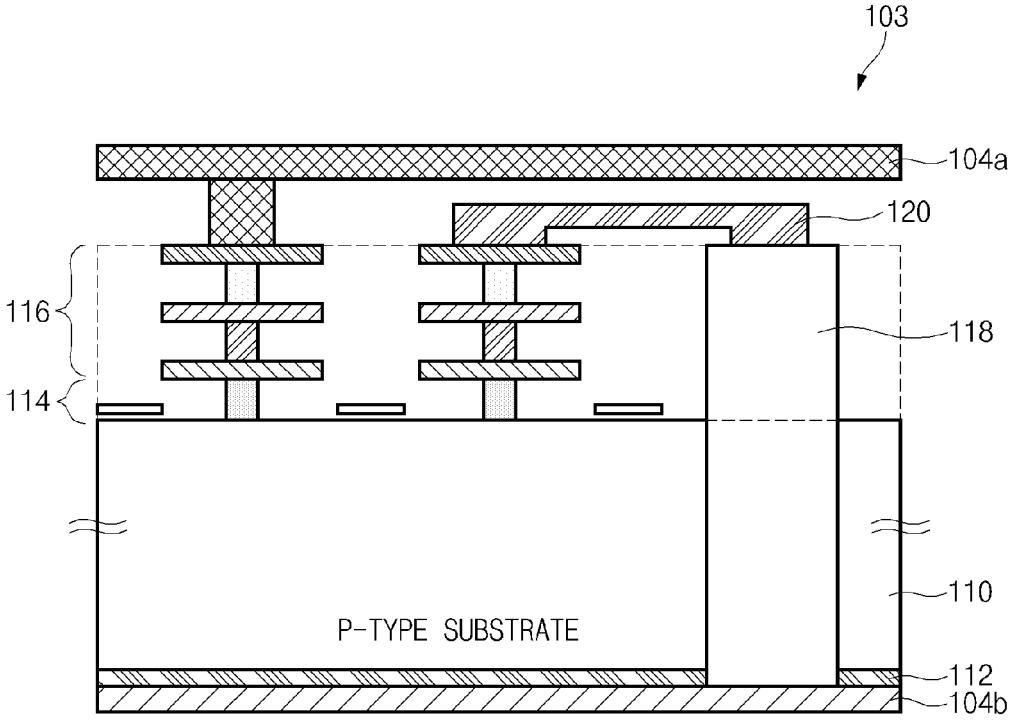
FIGS. 6 and 7 are structural views illustrating an RFID chip connected to an antenna of an RFID device according to embodiments of the present invention.

FIG. 6 is a detailed schematic diagram illustrating the RFID chip 103 shown in FIG. 5.

For convenience of description and better understanding of the present invention, the RFID chip 103 with pad electrodes 104*a* and 104*b* can be formed based on a technology for forming a through-trench pad and will hereinafter be described as an example of the present invention. The RFID device based on the aforementioned technology for forming the through-trench pad has been disclosed in Korean Patent Application No. 10-2007-0039303 filed by the same applicant as the present invention.

The RFID chip 103 according to the embodiment of the present invention reduces the layout of the RFID circuit on a wafer, and reduces a parasitic capacitance or resistance caused by the RFID circuit, so that it increases an operation speed and lowers power consumption.

For these purposes, the RFID chip forms a ground pad electrode 104*b* on a back side using a silicon through-hole pad electrode technology, completes a circuit fabrication on a front side of a substrate, and finally forms a signal input pad electrode 104*a*.

The fabrication process for forming the RFID chip will hereinafter be described with reference to the annexed drawings.

In order to perform the back-side fabrication process before starting the RFID through-trench pad forming process, the back side of the silicon wafer 110 enters a fabrication progressing status. In this case, it is preferable that the silicon wafer 110 be formed of a P-type substrate.

Thereafter, a buffer layer 112 for forming an antenna pad electrode is formed on the silicon wafer 110. In this case, the buffer layer 112 may be formed of a conductive layer and/or a non-conductive layer. Although the buffer layer 112 is formed of a conductive material, the bottom pad is used for a ground signal, so that the P-type substrate voltage is to be identical to the conductive layer voltage.

Subsequently, the bottom pad electrode 104*b* of the antenna is formed on the back side of the silicon wafer 110. Then, a Complementary Metal Oxide Semiconductor (CMOS) gate fabrication layer 114 and a metal fabrication layer 116 are formed on the front side of the silicon wafer 110.

Subsequently, a fabrication process for forming a silicon through-trench hole is carried out to form a plug through which a lower antenna pad electrode 104*b* (i.e., the bottom pad electrode) is connected to a ground voltage of the RFID circuit. A metal material is buried in the through-trench hole, so that a fabrication process for forming the plug 118 is carried out.

A metal line corresponding to a ground voltage of the RFID circuit is connected to a metal part of the plug 118, so that a ground voltage connection line 120 is formed. In addition, an upper antenna pad electrode 104*a* connected to another single input terminal is formed.

Figure 7:
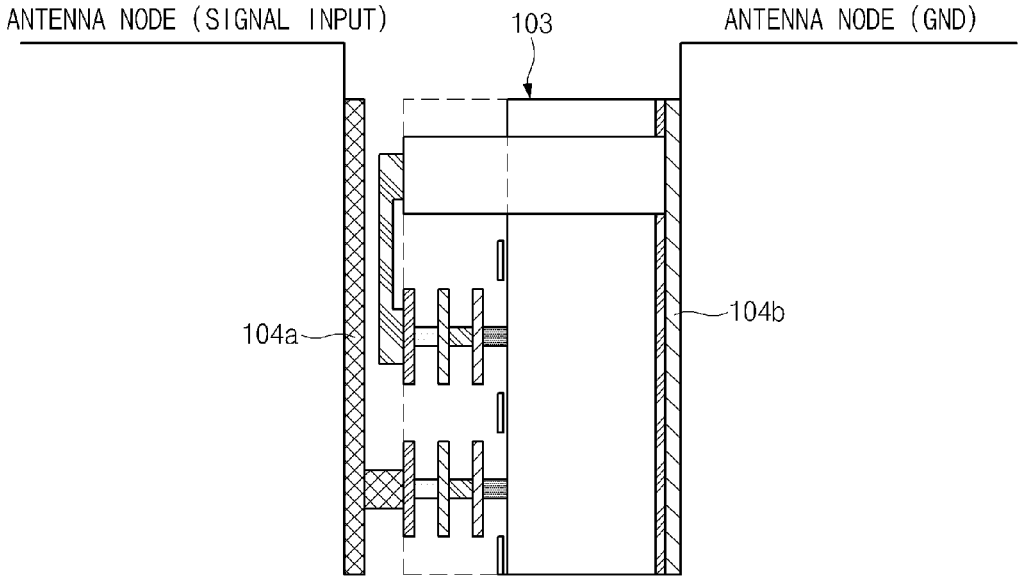
Figure 7:
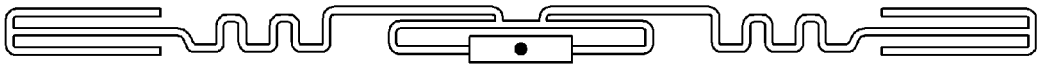

FIG. 7 is a conceptual diagram illustrating an antenna connection method according to an embodiment of the present invention.

Referring to FIG. 7, a node of the antenna electrode ANT (+) for inputting a signal is connected to the upper antenna pad electrode 104*a*, and a node of the other antenna electrode ANT(−) for inputting a ground voltage is connected to the lower antenna pad electrode 104*b*.

FIG. 7(*b*) shows an actual product wherein the RFID chip 103 is connected to the antenna. A ground antenna pad electrode 104*b* is formed on the back side using the silicon through-hole pad electrode technology, and the upper antenna pad electrode 104*a* is formed on the front side after the circuit fabrication has been completed on a silicon layer.

Accordingly, an additional layout space for forming a plurality of pads on the front side of the wafer is no longer required in the same manner as in the conventional pad configuration. In other words, one antenna pad is formed on a back-side silicon layer, and a through-trench plug electrode is formed thereon, so that a radio frequency (RF) signal generated from the antenna is transmitted to the front-side silicon circuit. Therefore, a layout area of the RFID circuit on the wafer is reduced, and a parasitic capacitance or resistance is reduced, so that a circuit driving speed is increased.

Figure 8:
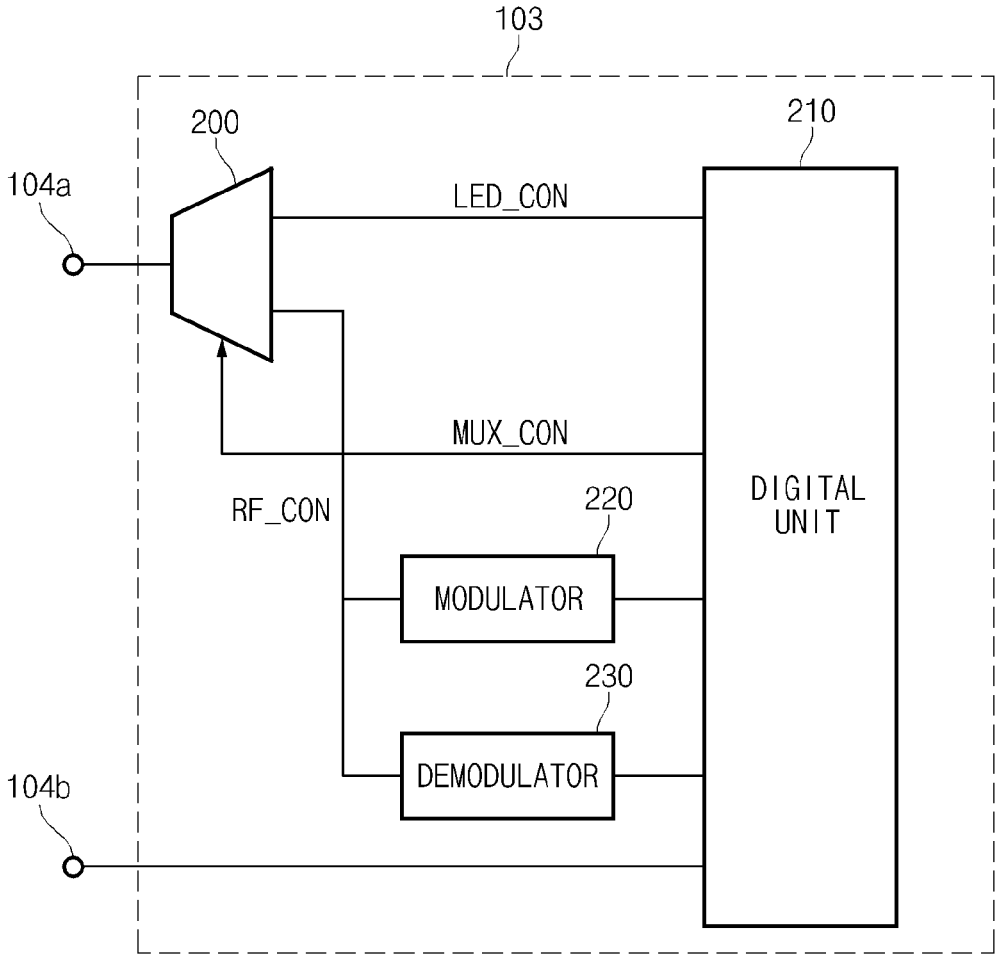
FIGS. 8 and 9 are a structural view and a timing diagram of an RFID chip, respectively, according to embodiments of the present invention.

FIG. 8 is a circuit diagram of the RFID chip 103 used in an embodiment of the present invention.

In the following description, although the antenna electrode ANT(+) or ANT(−) is used as a communication line for RF signals, it may also be used as a transmission/reception line of a control signal for controlling a driving device. For convenience of description and better understanding of the present invention, an LED is used as the driving device. The RFID device 103 includes a selector 200, a digital unit 210, a modulator 220, and a demodulator 230. The upper antenna pad electrode 104*a* and the lower antenna pad electrode 104*b* may be used as either a communication line for an RF signal or a transmission/reception line for a control signal controlling a driving device in response to a selection control signal (MUX_CON) received from the digital unit 210.

Figure 9:
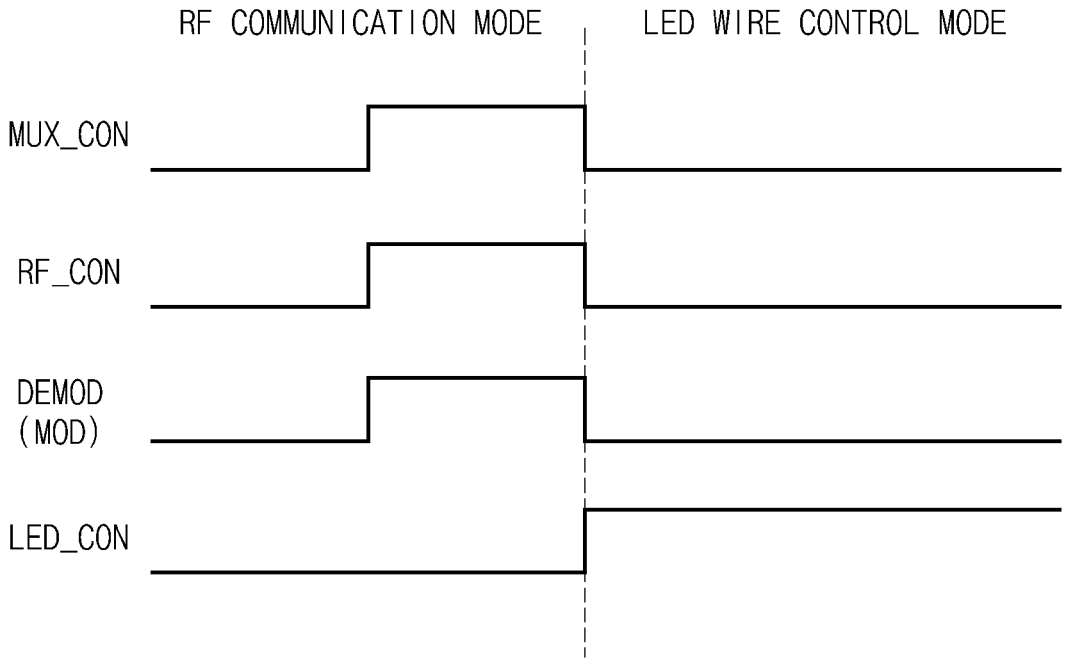

That is, if the selection control signal (MUX_CON) is enabled as a high level as shown in FIG. 9, the RFID chip is operated in an RF communication mode. Therefore, the selector 200 selects the RF control signal (RF_CON), and transmits and receives an RF signal through the upper antenna pad electrode 104*a* and the lower antenna pad electrode 104*b*. In this case, the modulator 220 or the demodulator 230 is driven so that a modulation signal (MOD) or a demodulation signal (DEMOD) is transmitted/received via an antenna.

In contrast, if the selection control signal (MUX_CON) is disabled as a low level as shown in FIG. 9, the RFID chip is operated in an LED wire operation mode. Therefore, the selector 200 selects an LED control signal (LED_CON), so that a control signal for controlling the LED is input/output through the upper antenna pad electrode 104*a* and the lower antenna pad electrode 104*b*.

In recent times, an illumination lamp installed in a building or the like may generally include a plurality of LED elements. In this case, several LED elements are respectively turned on or off so that the on/off control result appears as a special pattern of light. In addition, each illumination lamp may be controlled to have a user-desired brightness, or a certain illumination lamp arranged at a user-desired position may be separately controlled.

The above-mentioned scheme for controlling the illumination lamp may control the illumination lamp at a remote site through the RFID device. In other words, in the case where an RFID tag is attached to each LED and a desired radio frequency (RF) signal is transmitted to each RFID tag through an external reader, the RFID tag attached to the LED recognizes the transmitted RF signal and receives an additional comment according to a unique ID, so that the above-mentioned scheme can adjust as many LEDs as a user-desired number of LEDs and can control the user-desired number of LEDs to have a user-desired brightness.

The RFID tag is relatively cheaper than a general wireless remote controller. Accordingly, if the RFID tag is applied to the illumination lamp, the implementation cost can be decreased, resulting in greater convenience of a user. As apparent from the above description, the embodiment of the present invention has the following effects.

First, an antenna substrate is formed at a lower part of the antenna, so that it is easily connected to an external driver.

Second, the RFID chip is easily inserted into the antenna substrate through compression tension, so that a connection speed between the antenna and the RFID chip is increased.

Third, the antenna is connected to the RFID chip at high speed according to a simple insertion method, so that a relatively expensive bump process is omitted, resulting in reduction of production costs.

Although a number of illustrative embodiments consistent with the invention have been described, it should be understood that numerous other modifications and embodiments can be devised by those skilled in the art that will fall within the spirit and scope of the principles of this disclosure. Particularly, numerous variations and modifications are possible in the component parts and/or arrangements which are within the scope of the disclosure, the drawings and the accompanying claims. In addition to variations and modifications in the component parts and/or arrangements, alternative uses will also be apparent to those skilled in the art.

What is claimed is:

1. An antenna for use in a radio frequency identification (RFID) device, the antenna comprising:

an antenna substrate including a cavity that is configured to receive an RFID chip therein;

a first antenna electrode formed over the antenna substrate and in direct contact with the RFID chip inserted into the cavity, the first antenna electrode having a first end proximate to the cavity, the first end of the first antenna having a shaped upper corner; and a second antenna electrode formed over the antenna substrate and in direct contact with the RFID chip inserted into the cavity, the second antenna electrode having a second end proximate to the cavity, the second end of the second antenna having a shaped upper corner.

2. The antenna for use in the radio frequency identification (RFID) device according to claim 1, wherein the shaped upper corner of each of the first and second ends has a sloped structure, the sloped structure being tilted at a specific angle with respect to an upper surface of the antenna substrate to form a sloped surface of the sloped structure.

3. The antenna for use in the radio frequency identification (RFID) device according to claim 2, wherein each of the first end of the first antenna electrode and the second end of the second antenna electrode laterally extends beyond a sidewall of the cavity defined by the antenna substrate, wherein the first end and the second end are beveled so that lower potions of the first and second ends are longer than upper portions thereof.

4. The antenna for use in the radio frequency identification (RFID) device according to claim 1, wherein the antenna substrate is electrically coupled to an external driving device provided beneath the antenna substrate via a connector vertically extending through the antenna substrate.

5. The antenna for use in the radio frequency identification (RFID) device according to claim 4, wherein the driving device includes a light emitting diode (LED).

6. The antenna for use in the radio frequency identification (RFID) device according to claim 4, wherein the driving device includes a motor.

7. The antenna for use in the radio frequency identification (RFID) device according to claim 4, wherein the driving device includes a speaker.

8. The antenna for use in the radio frequency identification (RFID) device according to claim 4, wherein the first antenna electrode and the second antenna electrode are used as transmission/reception lines for a control signal controlling the driving device.

9. The antenna for use in the radio frequency identification (RFID) device according to claim 1, wherein the antenna substrate includes a through-via part that extends vertically through the antenna substrate.

10. The antenna for use in the radio frequency identification (RFID) device according to claim 9, wherein the through-via part connects the first antenna electrode and the second antenna electrode to an external driving device.

11. The antenna for use in the radio frequency identification (RFID) device according to claim 1, wherein an interval between the first antenna electrode and the second antenna electrode is less than a width of the RFID chip by a predetermined distance.

12. The antenna for use in the radio frequency identification (RFID) device according to claim 1, further comprising:

a molding layer that is formed over the first antenna electrode, the second antenna electrode, and the RFID chip.

13. The antenna for use in the radio frequency identification (RFID) device according to claim 1, wherein the first antenna electrode is coupled to an upper antenna pad electrode of the RFID chip so as to input a signal.

14. The antenna for use in the radio frequency identification (RFID) device according to claim 1, wherein the second antenna electrode is coupled to a lower antenna pad electrode of the RFID chip so as to input a ground voltage.

15. An antenna for use in a radio frequency identification (RFID) device, the antenna comprising:

an antenna substrate having a first surface and a second surface;

a first antenna electrode provided over the first surface of the antenna substrate and having a first end that is shaped;

a second antenna electrode provided over the first surface of the antenna substrate and having a second end that is shaped;

a space defined between the first and second ends, the space being configured to receive the RFID device;

an electrode over the second surface of the antenna substrate; and a connector extending vertically through the antenna substrate to electrically couple the first antenna electrode to the electrode provided over the second surface of the antenna substrate, wherein the first antenna electrode and the second antenna electrode are in direct contact with the RFID device.

16. The antenna of claim 15, wherein the antenna substrate defines a cavity that is configured to receive the RFID device inserted between the first end of the first antenna electrode and the second end of the second antenna electrode.

17. The antenna of claim 15, wherein the shaped upper corner of each of the first and second ends is configured to have a sloped structure, the sloped structure being tilted at a specific angle with respect to the first surface of the antenna substrate to form a sloped surface of the sloped structure.

* * * * *